United States Patent [19]

Stephens et al.

[11] 4,050,222

[45] Sept. 27, 1977

[54] ENVELOPE OPENING APPARATUS

[75] Inventors: Frederick N. Stephens, Paola; Glenford Rowlett, Prairie Village, both of Kans.; James D. Beard, Independence, Mo.

[73] Assignee: Stephens Industries, Inc., Lenexa, Kans.

[21] Appl. No.: 608,847

[22] Filed: Aug. 29, 1975

[51] Int. Cl.[2] ..... B65B 69/00

[52] U.S. Cl. ..... 53/381 R; 53/188; 53/266 A; 225/93; 271/112

[58] Field of Search ..... 53/381 R, 188, 266 A, 53/371, 381 R, 188, 266 A; 225/93; 271/30 A, 112, 173; 214/1 M

[56] References Cited

U.S. PATENT DOCUMENTS

| | | | |
|---|---|---|---|
| 2,168,241 | 8/1939 | Robinson | 53/371 |
| 2,781,620 | 2/1957 | Hopkins et al. | 53/188 X |
| 2,839,880 | 6/1958 | Boughton | 53/188 |
| 2,840,964 | 7/1958 | Kissling | 53/112 B X |
| 3,031,186 | 4/1962 | Galloway | 271/30 A X |
| 3,381,447 | 5/1968 | Ash et al. | 53/266 A X |
| 3,394,930 | 7/1968 | Guggisberg | 271/11 |
| 3,691,726 | 9/1972 | Stephens et al. | 53/381 R |
| 3,888,069 | 6/1975 | Pierce et al. | 53/381 R |

*Primary Examiner*—Travis S. McGehee
*Attorney, Agent, or Firm*—Shenier & O'Connor

[57] ABSTRACT

Envelope opening apparatus in which envelopes with previously slit top edges are supplied, one at a time, to a conveyor belt at a feeder station and are carried by the conveyor belt to an end slitting station in which each envelope is arrested, the faces of the arrested envelope are spread apart, and a pair of bursting members mounted for rectilinear movement in rectangular paths move downward into the envelope through its pre-slit top edge and outward against the respective envelope ends to burst them. Envelopes whose ends have been broken or burst are moved into successive radial slots of a rotary storage member for holding while the contents of the envelopes are removed and sorted.

30 Claims, 10 Drawing Figures

20
30
32
34
36
38
40
42
44
46
48
50
52
53
56
60
62
64
68
70
72
74
76
78
80
82
84
86
88
90
92
94
96
98
100
102
104
106
108
128
140
166
170
172
174
178
21
22
230
280
282
292
294
308
310
318
320
5
7
8
9

4
20
60
30
A
B
C 250
252
246
156
34
253
50
248
256
254
258
126
260
240
244
242
53
59
58
56
27
55
24
23
28
26

50
32
44
40
48
46
42
38
54
52
56
58
24
27
55
22
26
28
23

ENVELOPE OPENING APPARATUS

BACKGROUND OF THE INVENTION

This invention relates to apparatus for automatically opening rectangular envelopes, the top edges of which have previously been slit.

We have previously disclosed, in U.S. Pat. No. 3,691,726, entitled "Method and Apparatus for Opening Envelopes," an apparatus for automatically opening rectangular envelopes. In this apparatus, envelopes stacked initially in a feeder station are individually removed from the stack at a pick-off station located adjacent the feeder station and are moved to a top edge cutting station in which the top edge portion of the envelope is removed. The envelope is then moved through a drop chute station and is placed vertically in a V-shaped conveyor tray. The conveyor tray is advanced through an end breaking or separating station in which a pair of oppositely disposed suction cups separate the envelope sides and in which a pair of pivoted burster blades are moved downwardly into the envelope between the separated sides and outwardly against the respective side edges to break them. Finally, the envelope is moved through a sorting area in which the sides of the envelope are held open to expose the contents for removal and sorting.

Although the above-described apparatus satisfactorily achieves its objectives, it suffers an inherent design deficiency of being unable to accommodate, without readjustment, envelopes of varying sizes. That is, owing to the pivotal movement of the bursting blades in the end separating station, these blades are limited to a short stroke and the positions thereof must be readjusted to work with differently sized envelopes. In the feeder station, envelopes are maintained in an upright position by means of pairs of spaced feed dogs affixed to endless chains disposed along the sides of the envelope stack. This arrangement, of course, is operable only with envelopes having a uniform length. As a result of these limitations, time-consuming presorting is required in the usual case involving varying envelope sizes.

In addition to the foregoing the system disclosed in our prior patent is designed for multiple operator use. In the sorting area, the end-slit envelope is carried in the conveyor tray along a linear path of several tray lengths before the conveyor tray moves around an end sprocket wheel to dump the remaining tray contents into a waste receptacle. The linear layout required by the use of the conveyor trays involves a number of operators at the sorting station. Modified versions of the apparatus of our prior patent designed for single operator use have not provided adequate storage for opened envelopes to permit the operator to remove and sort the contents with ease.

SUMMARY OF THE INVENTION

One of the objects of our invention is to provide an automatic envelope opening apparatus which accepts envelopes of varying sizes without requiring readjustment.

Another object of our invention is to provide an automatic envelope opening apparatus which facilitates removal and sorting of the contents of opened envelopes.

A further object of our invention is to provide an automatic envelope opening apparatus especially designed for single operator use.

Other and further objects will be apparent from the following description.

In general, our invention contemplates an envelope opening apparatus having an endless conveyor belt and feeder means, located at one end of the conveyor belt, for supplying the belt with envelopes, the top edges of which have previously been slit. The envelopes are carried by the conveyor belt to an end breaking station which includes means for arresting the motion of an envelope carried by the conveyor belt, spreader means for separating the sides of the arrested envelope, an end bursting means for entering the spread envelope through its previously slit top edge and moving outwardly against each of the envelope ends to burst said ends. Preferably, the arresting means comprises a stop member which is selectively movable across the path of the envelope to be arrested. The spreader means preferably comprises a plurality of suction cups disposed along opposite sides of the conveyor belt, which cups are selectively movable between a first position in which the faces of the cups lie in a common plane and a second position in which the cups are separated from one another, which cups are further selectively coupled to a vacuum souce. The end breaking means comprises a pair of vertically oriented breaker blades spaced along the length of the conveyor belt at the end bursting station with the blades being mounted for translational movement around generally coplanar rectangular paths each of which has an inner vertical leg extending downwardly into the spread envelopes and a lower horizontal leg extending outwardly through one of the envelope ends. The inner vertical leg of the upstream blade path is spaced from the stop by a distance less than the length of the shortest envelope to be handled while the horizontal leg of the upstream blade path is sufficiently long to ensure that the trailing end of the longest envelope to be encountered will be burst.

Our invention also contemplates a feeder means for supplying envelopes one at a time to the conveyor belt along a vertical discharge path, which comprises an envelope stack support surface having a discharge end which is disposed adjacent to the discharge path and is formed with an upwardly extending retaining lip, means for biasing the stack of envelopes towards said discharge end, means disposed across said end for urging the leading envelope downward along said discharge path, and means for pulling the leading envelope across the retaining lip to permit said envelope to be fed downwardly along said discharge path. Preferably, the biasing is achieved by canting the stack support surface upwardly away from said discharge end, and placing a movable end plate behind the stack of envelopes. The pulling means preferably comprises a suction cup selectively movable against the leading envelope and selectively actuatable with a vacuum to grip said envelope. Preferably, the urging means comprises a pair of high friction rollers mounted on a common shaft across said discharge end. If desired, a pair of opposing feed rollers may be placed along the discharge path below the discharge end to assist feeding the envelope to the conveyor belt.

As will be apparent from the above description, the envelope stack is maintained in a vertical position by the upwardly extending lip and high friction rollers on one end and by the movable end plate on the other. Since none of these parts contacts either the lateral edges or the top edges of the envelopes forming the stack, it is possible to mix envelopes of varying lengths and heights without affecting the feeder's operation. The feeder thus complements the other portions of the apparatus in its ability to accept envelopes of varying sizes without adjustment.

Our invention additionally contemplates a sorting station in which a rotary member, formed with a plurality of angularly-spaced radial envelope-receiving slots, is rotatably mounted opposite the downstream end of the conveyor belt and is rotated to align successive envelope-receiving slots opposite the conveyor belt to receive envelopes successively discharged from the breaking station. Envelopes are ejected from the slots, after rotating about three fourths of a full revolution, by a high friction rotating disc which is placed over the rotary member at a suitable point; the ejected envelopes are directed into any suitable waste receptacle. This arrangement provides a compact sorting area which is readily serviceable by a single operator. With a rotary member having eight envelope-receiving slots spaced at 45° angles, the sorting station is capable of storing up to six envelopes at any one time, giving the operator ample time in which to "catch up" in sorting.

BRIEF DESCRIPTION OF THE DRAWINGS

In the accompanying drawings which form part of the instant specification and which are to be read in conjunction therewith and in which like reference numerals are used to indicate like parts in the various views.

DETAILED DESCRIPTION OF THE INVENTION

Figure 1:
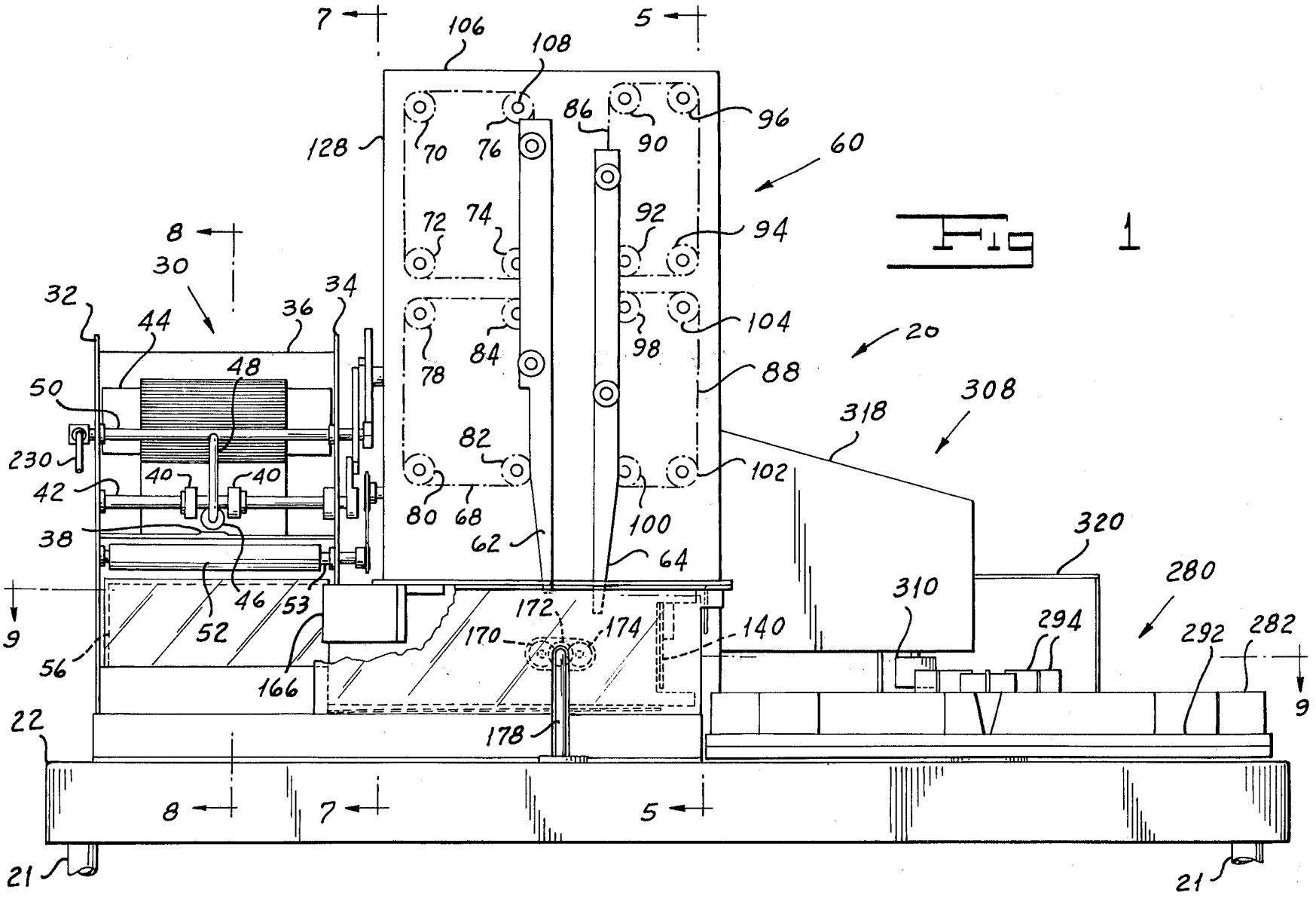
FIG. 1 is a front elevation view of an embodiment of our envelope opening apparatus, with some parts broken away.

Referring to FIG. 1, our envelope opening apparatus, indicated generally by the reference numeral 20, is supported on a horizontal frame 22 carried by a plurality of legs 21 and enclosed from below by a lower base plate 23. The apparatus 20 includes an endless conveyor belt 24 running from the left end of the frame, as seen in FIG. 1, to the middle thereof. The conveyor belt 24 is driven at a constant speed by a drive pulley 26 and is supported by a pair of idler pulleys 28 and 29 and by a horizontal support plate 27 to provide a horizontal transport surface for moving envelopes towards the middle of the frame 22. Our apparatus includes a feed unit, indicated generally by the reference character 30, for feeding envelopes, the upper edges of which have previously been slit, one at a time to the belt 24 which conveys each envelope to an end breaking or bursting unit, indicated generally by the reference character 60. After the ends of an envelope are broken it is delivered to a separating and holding unit, indicated generally by the reference character 280, which retains the open envelopes in position to permit the operator to remove the contents thereof, and from which the empty envelopes are removed in a manner to be described.

Figure 4:
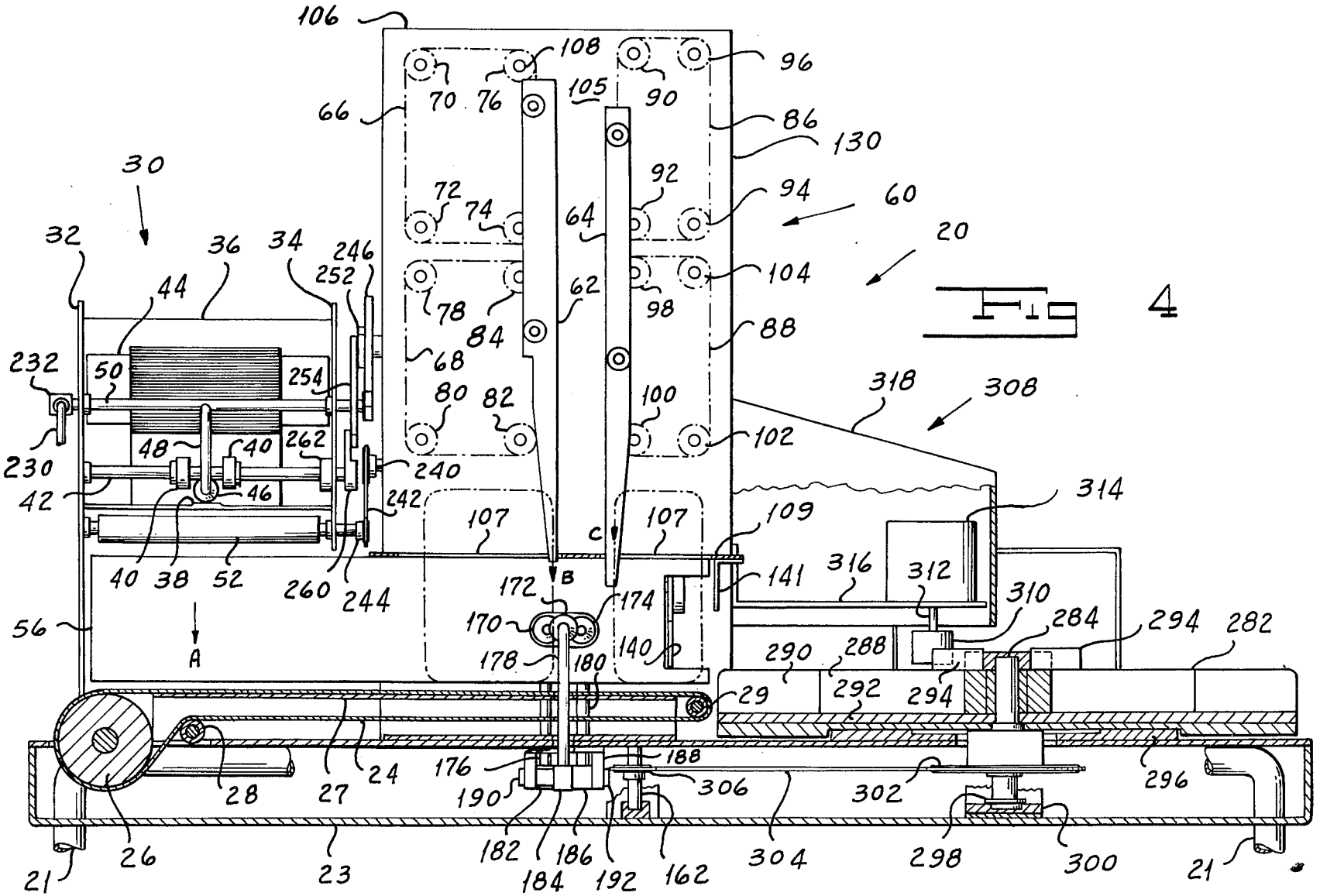
FIG. 4 is a sectional view of the apparatus shown in FIG. 1, taken along line 4—4 of FIG. 2, with some parts broken away.
Figure 8:
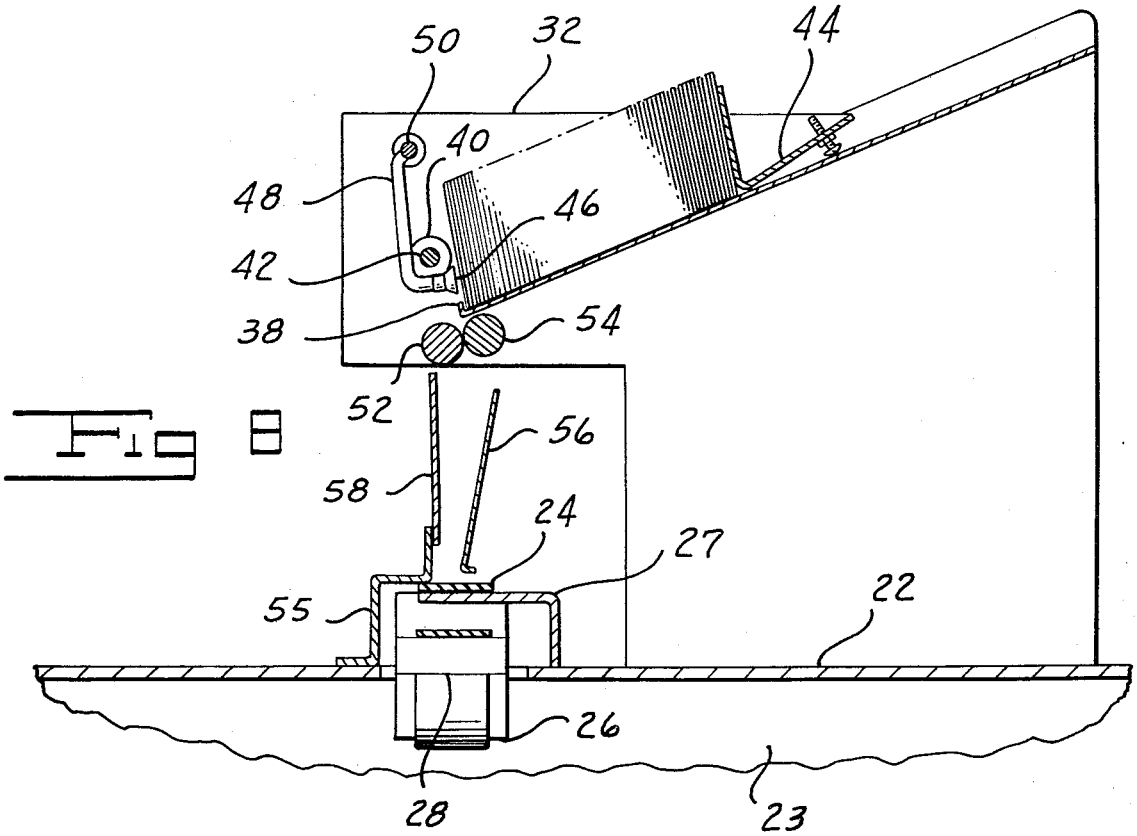
FIG. 8 is a fragmentary sectional view, taken along line 8—8 of FIG. 1, showing the internal structure of the feeder assembly, with some parts omitted for clarity.

Referring now to FIGS. 1, 4 and 8, the unit 30 feeds envelopes, the top edges of which have previously been slit by any suitable means, one at a time in an upright position along a discharge path A to the conveyor belt 24 adjacent to the left end thereof as viewed in FIG. 1. The feeder 30 includes a downwardly and forwardly inclined envelope support plate 36 disposed between a pair of side plates 32 and 34. Plate 36 is at least as wide as the largest envelope intended to be handled. Prior to their discharge, envelopes are retained on the support plate 36 in vertical position by means of an upwardly extending lip 38 provided along the center of the support plate's discharge end, and by a pair of high friction rollers 40 mounted on a shaft 42 disposed across the discharged end. The envelopes may be urged against the lip and the rollers 40 by any suitable means such as a movable end plate 44 placed behind the stack.

The leading envelope of the envelope stack is pulled across the retaining lip 38 to permit downward movement along the discharge path A by a suction cup 46 mounted for selective engagement with the leading envelope at a point intermediate the retaining lip 38 and the shaft 42 and intermediate the rollers 40. Preferably, the suction cup 46 is carried by a vertical arm 48 mounted on a shaft 50 supported in side plates 32 and 34. The cup 46 is pneumatically coupled in a manner to be described to a suitable vacuum source capable of being selectively actuated and deactuated during the operating cycle. A pair of feed rollers 52 and 54 mounted on respective shafts 53 and 59 are adapted to be driven to direct envelopes along the discharge path between a pair of guides 56 and 58.

Figure 2:
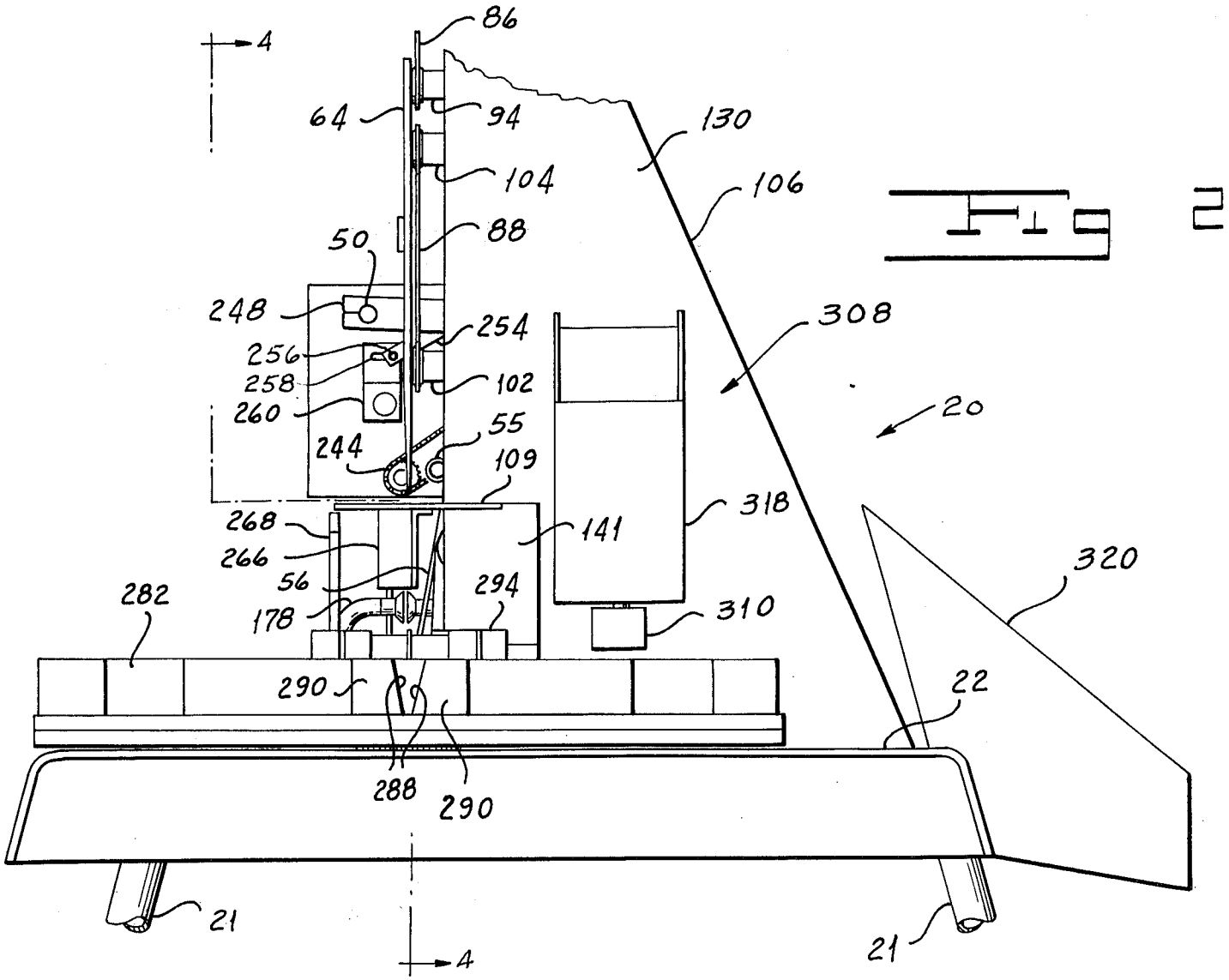
FIG. 2 is a fragmentary right side elevation of the apparatus shown in FIG. 1.

Referring now to FIGS. 1, 2 and 4 envelopes supplied to the conveyor belt 24 at the feeder station 30 are maintained in an upright position by means of the rear envelope guide 56 extending along the length of the conveyor belt 24 and by the front envelope guide 58 extending along that portion of the belt 24 beneath the feeder 30. An upper guide 266 is provided immediately downstream of the front guide 58 to properly orient the top edge of the envelope. The rear envelope guide 56 is attached to the underside of a blade guide 109 to be described, while the front guide 58 is attached to a runner plate 55 which extends along the length of the conveyor belt 24. If desired, the runner plate 55 may be fitted with a transparent guard plate 268 to protect against user injury.

Each envelope is carried by the conveyor belt 24, which is continually moving, to the end bursting unit 60, which includes a pair of breaker blades 62 and 64 for separating the side edges of an envelope moving through the end bursting unit 60. We mount the blades 62 and 64 for translational movement of their tips around paths B and C, respectively, to permit sequential movement into the envelope through the pre-slit top edge and outward movement through the envelope ends or side edges to break them. We mount blade 62 at spaced locations therealong or respective pitch chains 66 and 68 which are trained around respective sets of sprockets 70, 72, 74 and 76 and 78, 80, 82 and 84. Similarly, blade 64 is mounted at spaced locations therealong on respective pitch chains 86 and 88 which are trained around respective sets of sprockets 90, 92, 94 and 96 and 98, 100, 102 and 104. All of the chain supporting sprockets are carried by shafts 108 rotatably mounted on the front panel 105 of a slitter blade subframe 106 which extends over the conveyor belt 24 such that the blades 62 and 64 are disposed over the midline of the belt 24, as is shown in FIG. 2. Blades 62 and 64 move downwardly through slots 107 provided in a blade guide 109 mounted on the breaker blade subframe 106 beneath the front panel 105.

The shafts 108 supporting sprockets 72, 80, 94 and 102 extend through the front panel 105 to receive inner sprockets 110, 112, 114 and 116, respectively. Respective chains 118 and 120 connect the sprockets of the pairs 110 and 112 and 114 and 116. Gear boxes 122 and 124 couple the shafts 108 supporting sprockets 112 and 114 to a lower drive shaft 126, which is mounted in bearings 125 and 127 on the side panels 128 and 130 of the breaker blade subframe 106. The lower drive shaft 126 supports a sprocket 132 connected by a chain 134 to a drive sprocket 136 driven by the main drive motor 138 through a right angle gear (not shown). It will be seen that, through the above-described arranement, burster or breaker blades 62 and 64 are moved continually and in synchronism with one another through paths B and C, respectively. Breaker blade 64 is synchronized such that its tip traverses the midpoint of the right, top, left, and bottom legs of the cutting path C at 0°, 90°, 180°, and 270°, respectively, in the operating cycle. Slitter blade 62 is also synchronized to complete its circuit in an operating cycle, but is preferably delayed somewhat with respect to the blae 64 as is shown in FIGS. 1 and 4. For the purposes of simplicity in the following description, however, blades 62 and 64 will be assumed to traverse equivalent portions of their respective cutting paths simultaneously. It is to be noted that blades 62 and 64 are relatively dull or that they burst or break the envelope along its end edges. There is no cutting action such as might sever a folded check caught by a blade.

Figure 3:
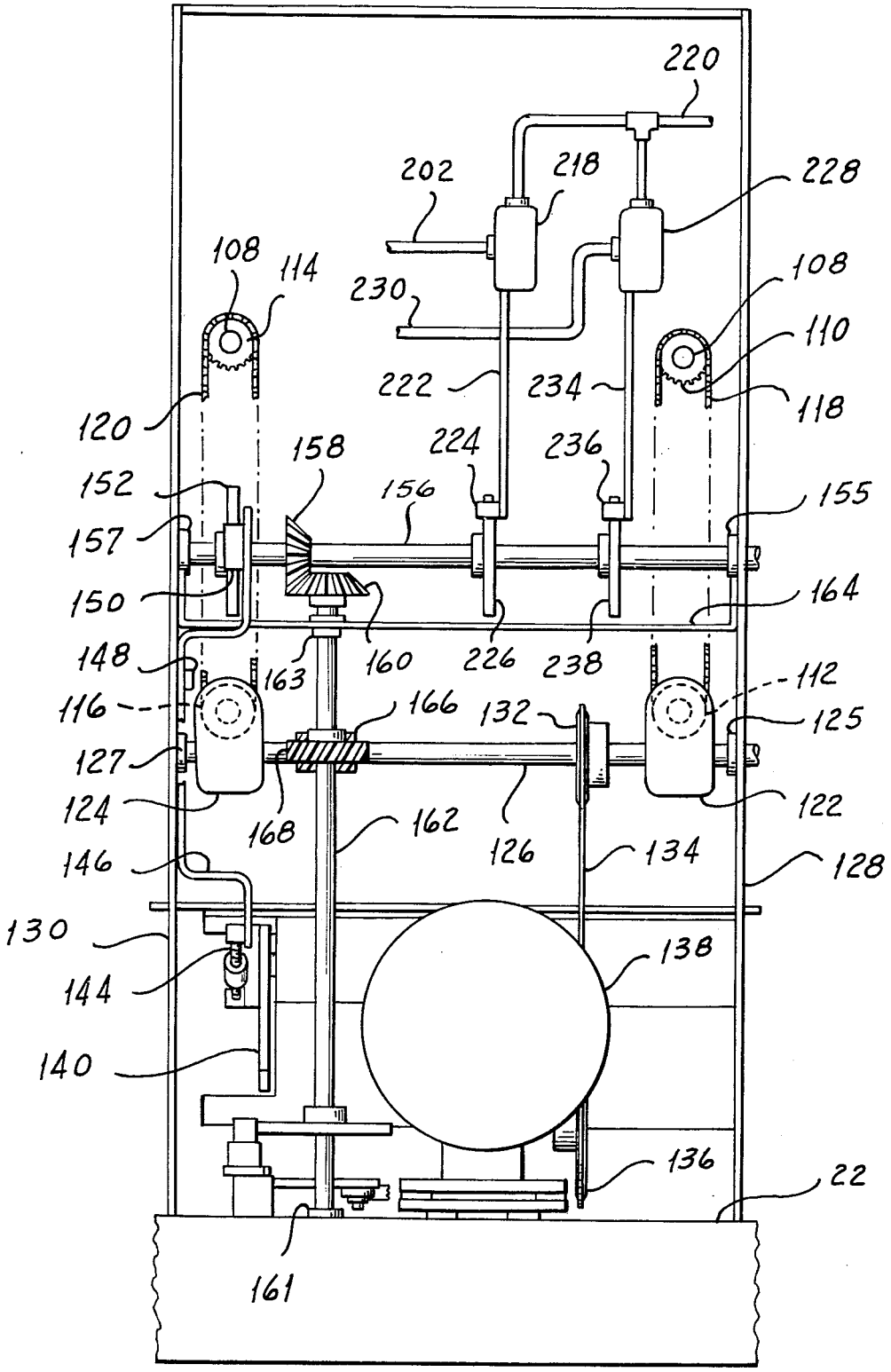
FIG. 3 is a fragmentary rear elevation of the slitter blade subframe of the apparatus shown in FIG. 1, with some parts broken away or omitted for clarity.
Figure 5:
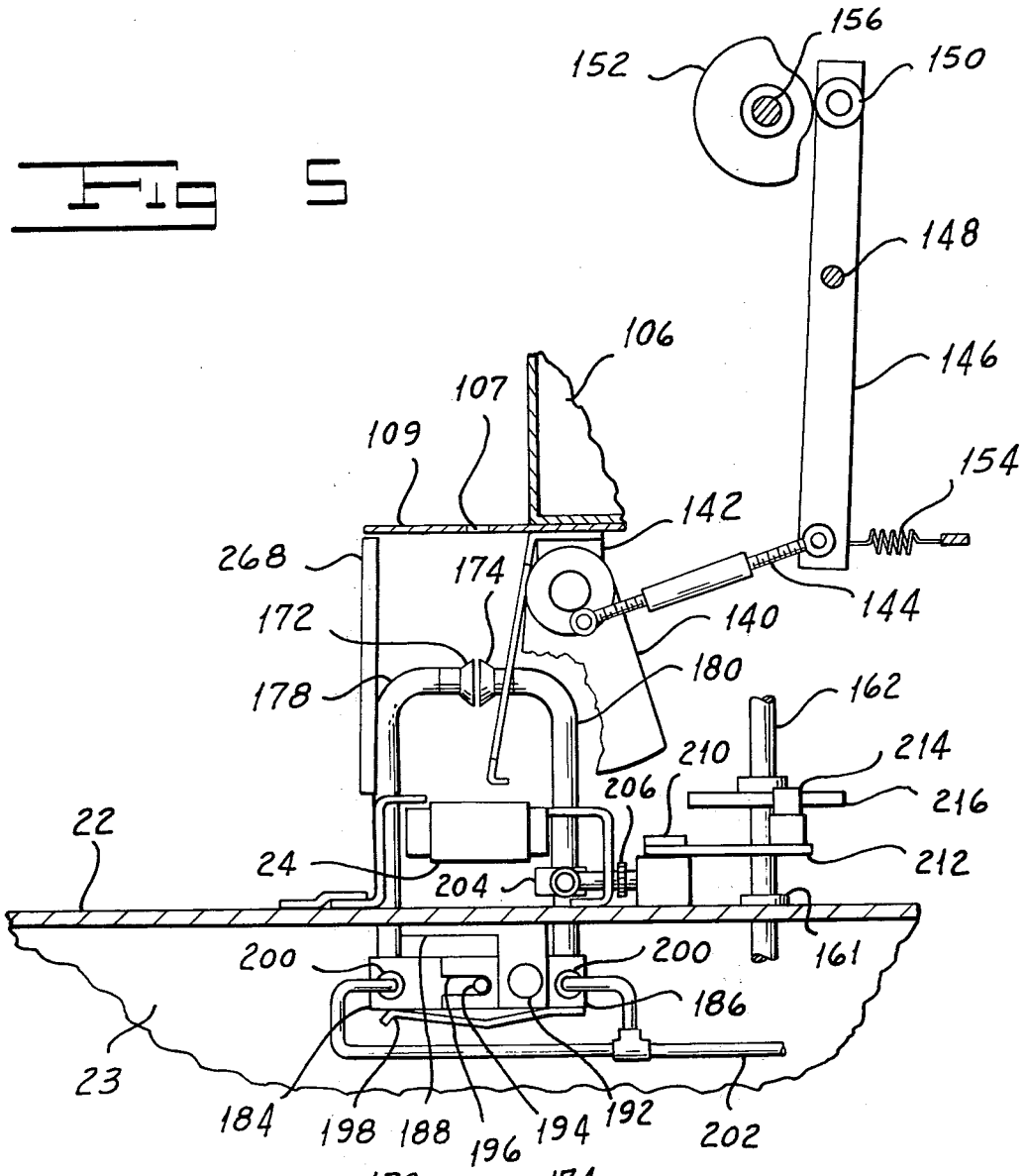
FIG. 5 is a fragmentary sectional view, taken along line 5—5 of FIG. 1, showing the spreader cup and stop assembly, with some parts broken away or omitted for clarity.
Figure 6:
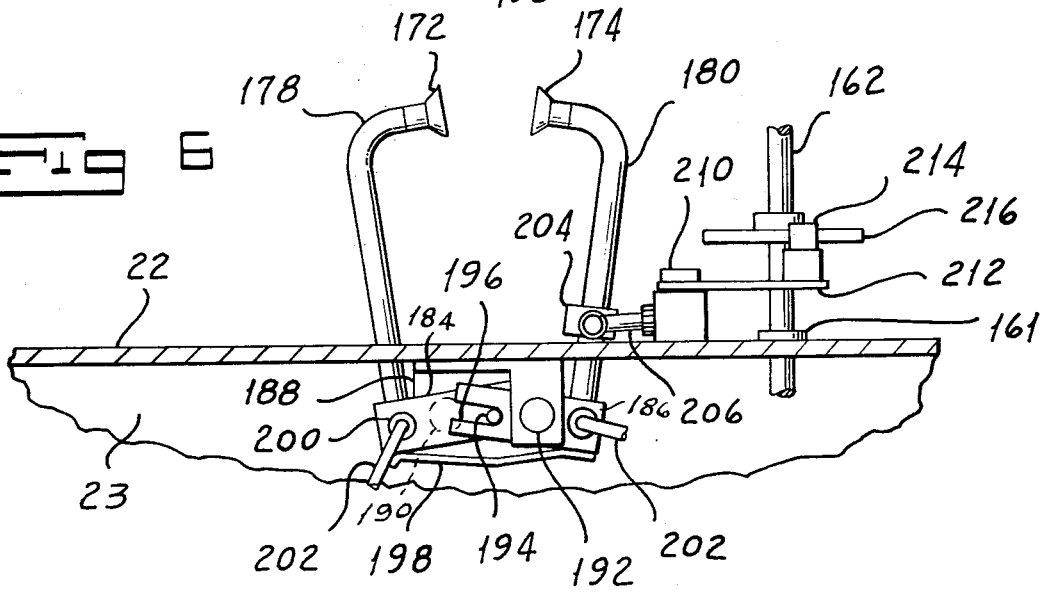
FIG. 6 is a view of the spreader cup assembly of FIG. 5, showing the spreader cups in a separated position.
Figure 7:
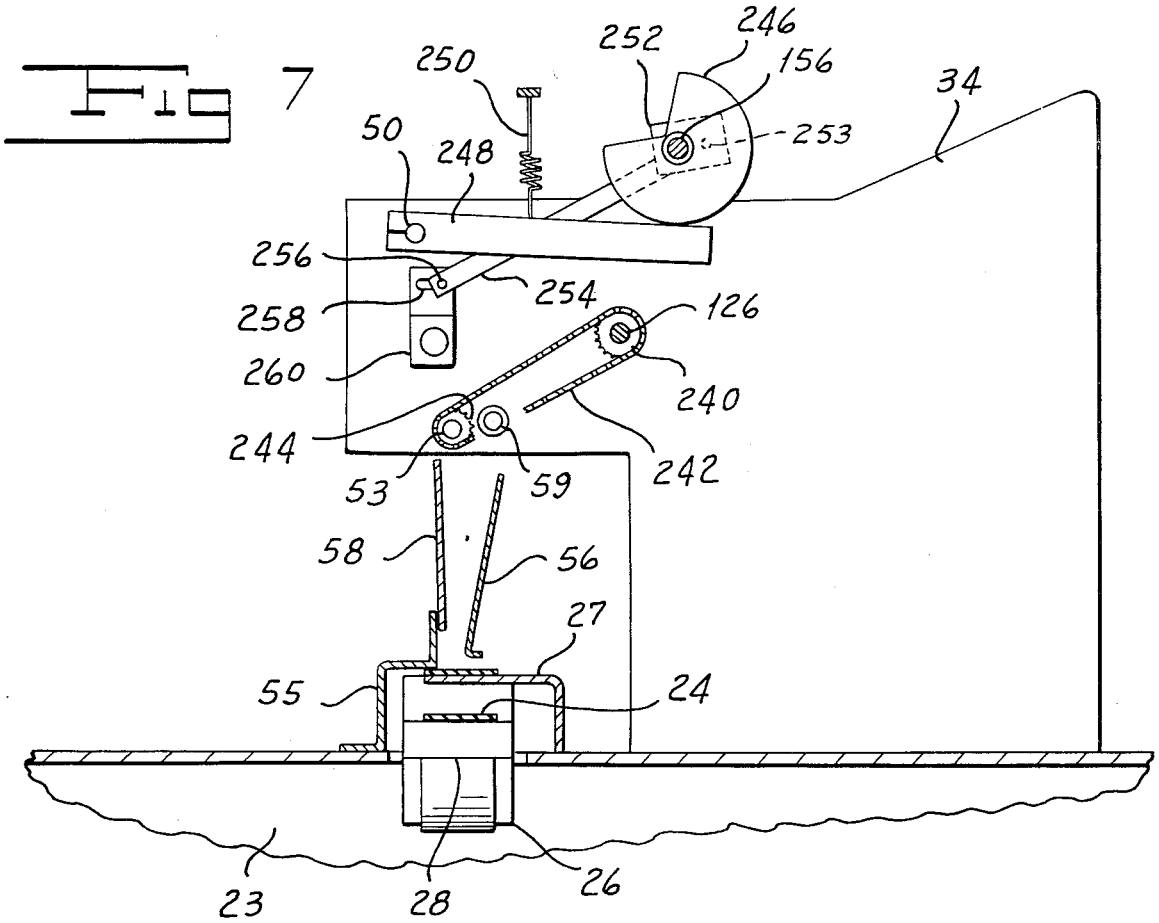
FIG. 7 is a fragmentary sectional view, taken along line 7—7 of FIG. 1, showing the feeder assembly and related timing assemblies, with some parts omitted for clarity.

Referring now to FIGS. 3, 4 and 5 we mount a stop 140 on a bracket 142 carried by subframe 106 adjacent to the right end of the subframe 106 as viewed in FIG. 4 for movement between a retracted position and an extended position in the path of an envelope carried by the belt 24. The stop 140 is actuated to selectively block the conveyor path by an adjustable actuator link 144, one end of which is eccentrically mounted on the stop 140 and the other end of which is pivotally attached to one end of a lever 146. Lever 146 is pivotally mounted on the side panel 130 at a fulcrum point 148 located above the actuator 144. A cam follower 150 at the other end of lever 146 is urged into engagement with a cam 152 by a spring 154 coupled to the lever arm end attached to the actuator 144. The cam 152 is carried on an upper drive shaft 156 which is supported in bearings 155 and 157 in side panels 128 and 130, respectively, above and parallel to the lower drive shaft 126. A vertical drive shaft 162 supported is respective bearings 161 and 163 in frame 22 and in a bracket 164 carries a bevel gear 160 which drives a bevel gear 158 on shaft 156. The vertical drive shaft 162 is coupled to the lower drive shaft 126 through a worm 166 and an intermeshing worm wheel 168. It will be apparent from the foregoing description that the upper drive shaft 156 is coupled to the lower drive shaft through the vertical drive shaft such that the cam 152 is rotated to actuate the stop 140 in synchronism with the movement of the breaker blades 62 and 64.

Referring now to FIGS. 4 to 6 and 9 our means for spreading an envelope prior to entry of the breaker blades includes a plurality of suction cups 170, 172 and 174 carried by respective arms 176, 178 and 180. A bracket 188 secured to the underside of frame 22 by any suitable means supports a pair of pivot shafts 190 and 192. Shaft 190 supports a mounting block 184 which carries cup arm 178 while shaft 192 supports blocks 182 and 186 which respectively carry arms 176 and 180. We so position the cups 170, 172 and 174 as to be spaced above the belt 24 by a distance which is less than the height of the smallest envelope to be handled and to be spaced from stop 140 by a distance less than the length of the smallest envelope to be handled. Moreover, we arrange cup 172 to engage one panel of the envelope at a location between the locations at which cups 170 and 174 engage the other panel. While in the embodiment shown, a pair of cups 170 and 174 are provided behind a conveyor belt and a single cup 172 is provided in front of the belt 24, the exact number and spacings of cups is not critical so long as at least one cup, of course, is provided on each side of the conveyor belt 24. A pin 194 on block 184 rides in a slot 196 in block 186 so that when block 184 pivots in one direction block 186 pivots in the other direction. A spring 198 secured to the underside of blocks 182 and 186 engages block 184 normally to urge the cups 170, 172 and 174 into engagement along the center line of the belt 24. A fitting 200 on each block 182, 184 and 186 connects the associated arm to a vacuum line 202.

Cup arms 176, 178 and 180 are actuated by means of a fork 204 which receives cup arms 176 and 180. A link 206 connects fork 204 to one arm 208 of a bell crank carried by a vertical pivot shaft 210. A cam 216 on shaft 162 engages a cam follower 214 carried by the other arm 212 of the bell crank.

Referring to FIG. 3, a normally closed valve 218 connects line 202 to a main suction line 220. A cam 226 on shaft 156 is adapted to actuate a follower 224 on an arm 222 to open valve 218.

After the envelope has had its ends separated in the end breaker unit 60, it is allowed to move off the end of the conveyor belt 24 supported by the pulley 29 into a holding unit indicated generally by the reference numeral 280. Referring particularly to FIG. 1, 2, 4, and 9, unit 280 includes a rotary member 282 mounted on a shaft 284 for rotary movement adjacent to the conveyor belt 24. The axis of a shaft 284 is in line with the conveyor belt centerline. The rotary member 282 is formed with a plurality of angularly-spaced, upwardly opening radial slots 286 for receiving envelopes supplied from the conveyor belt 24. In the embodiment shown, eight slots are provided at 45° angle intervals. Preferably, the slots 286 are generally V-shaped in cross section being slightly wider at the top. Moreover diverging slot wall portions 290 form a mouth at the entrance to each slot 286 as to present a relatively wide aperture to envelopes moving off the conveyor belt 24. The floor 292 of member 282 is preferably spaced slightly below the working surface of the conveyor belt 24. We provide vanes 294 extending radially from the center of the member 282 over the inner portions of the respective slots 286 to separate the sides of the envelope which has been moved into the slot 286.

The rotary member 282 is supported for rotation by a lazy susan bearing 296 mounted on the frame 22 and by a second bearing 298 mounted in a supporting block 300. A sprocket wheel 302 on shaft 284 is connected by a chain 304 to a second sprocket wheel 306 on the vertical drive shaft 162. We provide sprocket wheels 302 and 306 with a suitable sprocket ratio to rotate the rotary member shaft 284, 45°, or one eighth of a revolution, for every revolution of the vertical drive shaft 162. Preferably, the rotary member 282 is oriented such that successive slots 286 are aligned with the conveyor belt 24 midline, when the opened envelope is released from the end breaker unit 60.

Figure 9:
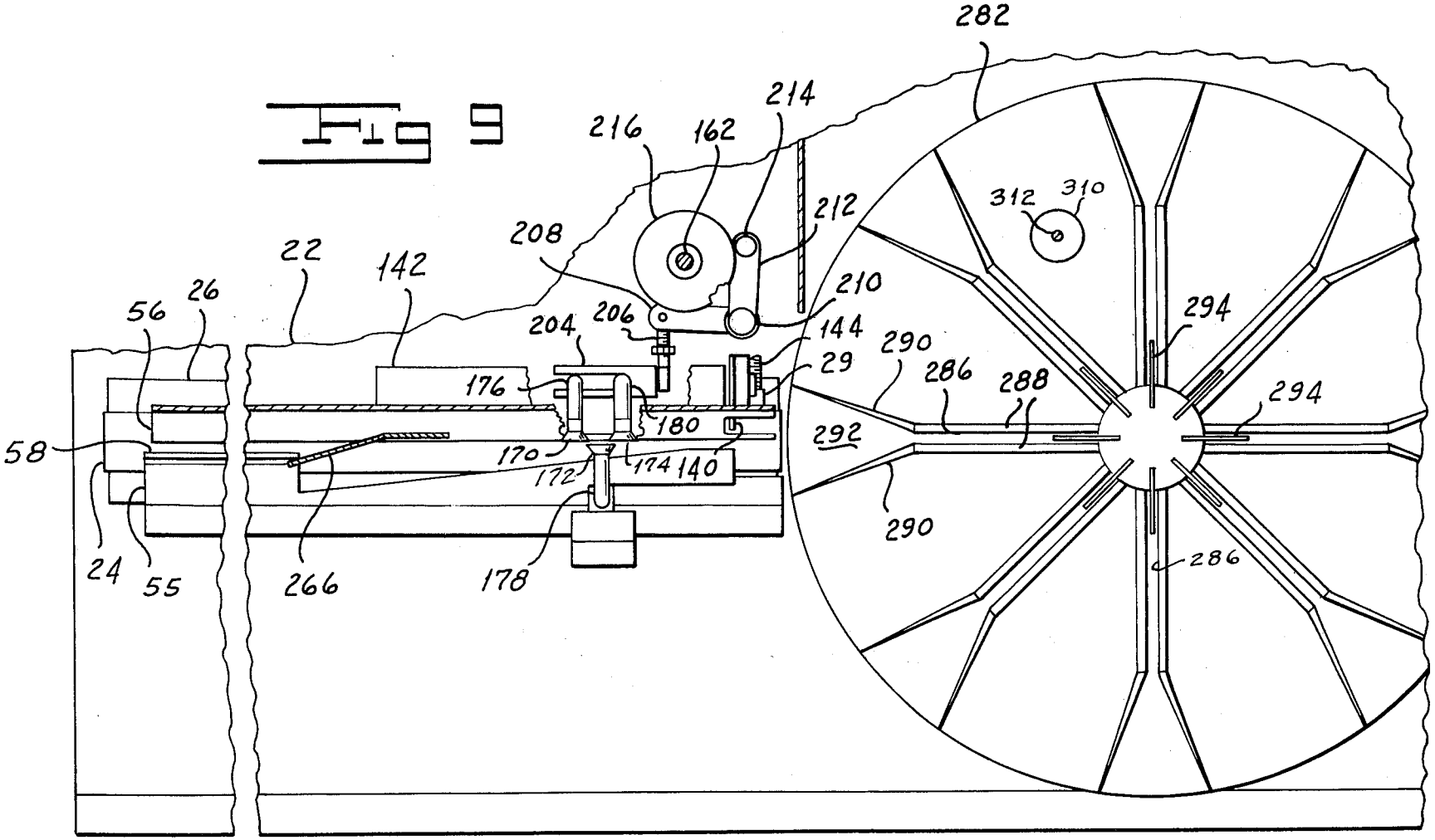
FIG. 9 is a fragmentary sectional view, taken along line 9—9 of FIG. 1, showing various parts of the apparatus, with some parts broken away or omitted for clarity.

The rotary member 282 serves as a buffer storage area for envelopes which have been ejected from the end breaker station 60, but have not yet had their contents removed and sorted by the operator. About 6½ operating cycles after the envelope has been fed to the rotary member 282, by which time the envelope contents should have been removed the empty envelope is ejected from its slot 286 at a contents removal station indicated generally by the reference numeral 308. At the contents removal station 308, a high friction disc 310 is disposed over the rotary member 282 at a location to the rear of the conveyor belt as is shown in FIGS. 2, 4 and 9. The high friction disc 310 is spun counterclockwise at a high speed by a motor 314 coupled to the roller 310 by a shaft 312. The motor 314 is supported by an L-shaped mounting bracket 316 secured to the subframe right side plate 130, and is covered by a housing 318 also secured to the side plate 130. Envelopes removed from the rotary member 282 by the disc 130 are directed through a deflector member 320 (FIGS. 2 and 4), mounted to the frame 22 behind the rotary member 282, and drop into a suitable receptacle (not shown) placed beneath the deflector 320.

Referring now to FIGS. 2 to 4, 7 and 8, the movement of the various parts of the feeder unit 30 are timed by means of respective first and second drive shafts 126 an 156, each of which rotates through 360° in the course of an operating cycle in a manner to be described. Shafts 126 and 156 extend through the left side panel 128 of the slitter blade subframe 106. Shaft 126 receives a sprocket 240 coupled through a chain 242 to a sprocket 244 secured to the shaft 53 supporting the feed roller 52. Drive shaft 156 drives cam 246 which controls the pickoff arm pivot shaft 50 through an arm 248, one end of which is secured to the shaft 50 and the other end of which is urged against the cam by a spring 250. The upper drive shaft 156 drives an eccentric 252 which is attached to one end of a reciprocating arm 254 by means of a pin 253. The other end of the arm 254 carries a pin 256 which engages a slot 258 formed at the end of a crank arm 260 which is coupled, through a one-way clutch 262, to the high friction roller shaft 42 of the feeder assembly 30. The clutch 262 is oriented so as to be engaged during the backward stroke of the arm 254 to drive the shaft 42 clockwise (as seen in FIG. 8) and to remain disengaged during the forward stroke.

As shown in FIG. 4 the feeder unit suction cup 46 is coupled to a vacuum line 230 by any suitable means, such as a coupling block 232 mounted to the right end of the cup arm pivot shaft 50. As shown in FIG. 3 vacuum line 230 is in turn coupled through a normally closed valve 228 to the vacuum supply line 220. The valve 228 is controlled by an arm 234 which urges a cam follower 236 against a cam 238 carried on the upper drive shaft 156.

Figure 10:
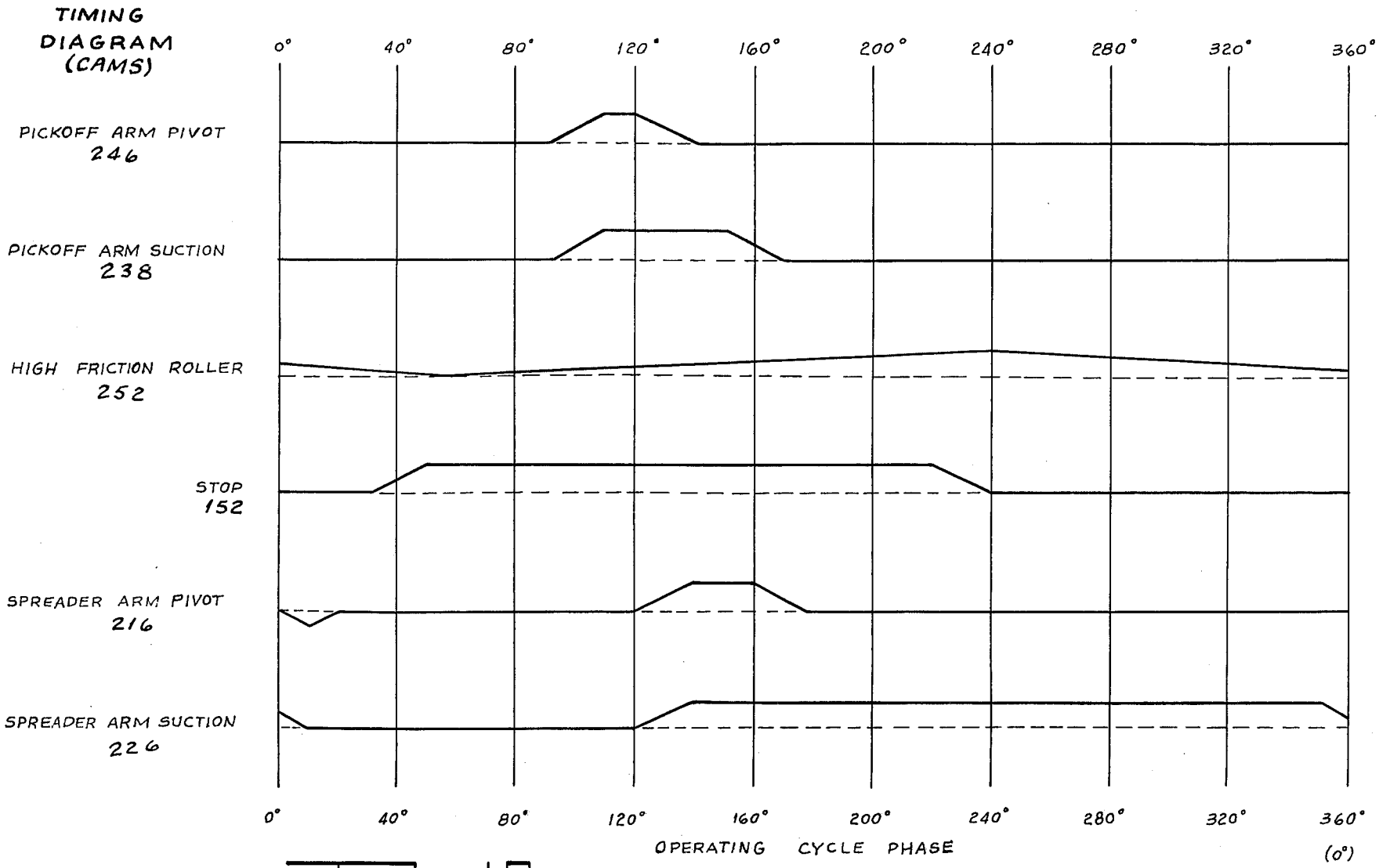
FIG. 10 is a timing diagram showing the relative sequence of operation of the various parts of our apparatus.

The timing of the various moving parts of the feeder station 30 with respect to an arbitrarily defined 360° operating cycle is shown in FIG. 10. Thus, the pickoff arm pivot cam 246 is shaped to actuate the pickoff arm pivot shaft 50 in accordance with the "Pickoff Arm Pivot" plot of the timing diagram shown in FIG. 10. Similarly, the movement of the high friction roller arm 254 is timed in accordance with the "High Friction Roller" plot of FIG. 10, the rising and falling portions of the plot corresponding to the backward and forward strokes of the arm 254, respectively. Finally, the pickoff arm suction arm 238 is timed to actuate the valve 228 in accordance with the "Pickoff Arm Suction" plot shown in FIG. 10. It should be emphasized that these particular timing plots are examplary only, and that the exact timing to be used in any particular implementation will depend on the physical dimensions, frictional properties, and other characteristics of the apparatus in question.

The operation of the feeder station 30 will now be described in some detail. We arbitrarily begin out description at 60° phase in the operating cycle, as defined in FIG. 10, at which point the pickoff arm suction cup 46 is displaced from the envelope stack and uncoupled from the vacuum line 220, while the high friction rollers 40 are just beginning their half-cycle clockwise movement. At about 100° in the operating cycle, picker arm cam 246 allows the rear end of actuator arm 248 to ride upwards, causing a corresponding rotation in the picker arm pivot shaft 50 to bring the suction cup into contact with the leading envelope. At the same time, as can be seen by reference to FIG. 3 the pickoff arm suction cam 238 moves arm 234 into a position to actuate the bleed valve 228, coupling the vacuum suply line 220 to the line 230 coupled to the suction cup 46 to cause suction cup 46 to grip the leading envelope. Shortly thereafter, at about 130° in phase, picker arm cam 246 pushes the rear end of arm 248 downward to cause picker arm 48 to swing away from the envelope stack, pulling the leading envelope along with it across the lip 38. Thereafter, at about 160° phase, cam 238 deactuates bleed vale 228 to remove the vaccum from suction cup 46. At this point, the leading envelope passes between rollers 52 and 54 and drops onto the conveyor belt 24. While the exact instant at which the envelope reaches the belt 24 is dependent on a number of factors, including the speed of rollers 40, 52, and 54 and the vertical distance involved, it will be assumed, in discussing the operations subsequently performed on the envelope, that the latter reaches the conveyor belt 24 at about 40° in the subsequent opearating cycle. At 60° in the subsequent operating cycle, as defined in FIG. 10, the feeder assembly has completed its cycle and a second envelope, now the leading envelope, may be supplied to the conveyor belt 24 in the same manner as the first.

In a manner similar to that of the feeder station 30 moving parts, the moving parts of the end burster station 60 are timed with respect to the reference 360° operating cycle as shown in FIG. 10. Thus, the stop cam 152 is timed to move the stop 140 into a blocking position over the conveyor belt 24 in accordance with the "Stop" plot shown in FIG. 10. Similarly, the spreader arm pivot cam 216 is timed to permit spreader arms 176–180 to move together in accordance with the "Spreader Arm Pivot" plot shown in FIG. 10. And finally, the spreader arm suction cam 226 is timed to couple spreader arms 176–180 to the vacuum supply line 220 in accordance with the "Spreader Arm Suction" plot shown in FIG. 10. As has previously been explained, these particular timing plots are exemplary only. The exact timing to be used is dependent on such factors as the physical dimensions, the frictional properties, and conveyor belt speed of the apparatus in question.

Having described structurally the various components of the end breaker unit 60, we will now describe their operation through a typical cycle. Referring to the timing diagram shown in FIG. 10, the end burster or breaker unit cycle is best thought of as beginning at the 30° point in the operating cycle as depicted therein. At this point, the stop 140 is retracted from the conveyor belt path and the spreader cups 170–174 are separated, as in FIG. 6, and unactuated. At about 40° in phase an envelope is dropped onto the conveyor belt 24 at the left end by the feeder unit 30, as has been previously described, while, at about the same time, as can be seen by reference to FIG. 5, the stop cam 152 pushes the upper end of pivot arm 146 backwards to cause the lower end of the arm 146 to swing forward to move the stop 140 across the path of the envelope. The envelope dropped onto the conveyor belt 24 by the feeder unit 30 is moved by the belt towards the right of the apparatus, as seen in FIG. 4, until the envelope abuts the projecting stop 140, at which point the envelope is stopped and the belt 24 continues to slip beneath the envelope. To account for variations in envelope length, belt speed, and the exact instant at which the envelope is dropped onto the belt 24, a quarter-cycle quiescent period, from 40° to about 130°, is provided for this stopping to occur.

At about 130° in the operating cycle, spreader arm cam 162 permits actuator arms 208 and 212 to pivot counterclockwise around their pivot point 210. This motion is transmitted through links 206 and 204 to cause spreader cups 170, 172 and 174 to move together to contact opposite faces of the envelope arrested by the stop 140. At the same time, the spreader arm suction cam 226 actuates bleed valve 218 through arm 222 to couple the spreader cups 170, 172 and 174 to the vacuum line 220 to cause cups 170, 172 and 174 to pneumatically grip the faces of the envelope sandwiched therebetween. Shortly thereafter, at about 170°, spreader arm cam 216 causes actuator arms 208 and 212 to pivot clockwise to their former position to separate suction cups 170, 172 and 174 and, thereby, the faces of the envelope.

At this point, the spread envelope is in a suitable disposition to have its end separated by the breaker blades 62 and 64. As has previously been described, each of the blades 62 and 64 is at the midpoint of the inner leg of its respective path at the 180° point in the operating cycle. Between this point, approximately, and about 200°, depending on the exact envelope height, breaker blades 62 and 64 enter the envelope between the spread faces and continue to move downward until about 240°, at which point they begin to move outward along the bottom legs of their respective cutting paths B and C.

As blades 62 and 64 begin to move horizontally outwardly, at about 230° in phase, the stop cam 152 actuates the arm 146 to retract the stop 140 to provide breaker blade 64 an unobstructed path along the bottom leg of the cutting path C. Each of the blades 62 and 64, in moving outward along its respective path bottom leg, breaks through the respective envelope end before moving upward along its outer leg; suction cups 170, 172 and 174 hold the envelope in place while this occurs. At about the midpoint of the blades' upward movement, or about 360° (0°) in phase, spreader arm suction cam 226 deactuates bleed valve 218 to remove the vacuum from the spreader cups 170, 172 and 174 to allow the slit envelope to resume movement with the conveyor belt 24. To assist in freeing the cups 170, 172 and 174 from the slit envelope, spreader arm pivot cam 216 momentarily actuates pivot arms 206 and 212 to move spreader cups 170, 172 and 174 slightly outward from their normal separated position shown in FIG. 6, this occurring at about 10° in phase. After the spreader cups 170, 172 and 174 resume their normal separated position, the end slitting unit cycle is complete.

It will be seen that we have accomplished the objects of our invention. We have provided an automatic envelope opening apparatus which accepts envelopes of various sizes without requiring readjustment. Further, it facilitates removal and sorting of the contents of opened envelopes by a single operator.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. Apparatus for opening an envelope previously slit along one edge thereof, comprising:

9 pair of blades;

means for positioning the envelope with said one edge thereof adjacent said blades;

means mounting said blades for movement along respective paths, each including a first portion extending from a point outside the envelope to a second point within the envelope and a second and rectilinear portion extending from said second point through an edge of the envelope adjacent said one edge to a predetermined third point beyond said adjacent edge, said means mounting the blades for translational movement along the second portions of said paths; and means for driving the blades along said paths with a sufficient driving force to move said blades from said second points through the edges of the envelope adjacent to said one edge to said predetermined third points to break said adjacent edges.

2. Apparatus as in claim 1 in which said positioning means comprises means for moving envelopes past said blades and means for arresting the movement of an envelope carried by said conveying means when said envelope is adjacent to said breaker blades.

3. Apparatus as in claim 2 in which said moving means comprises an endless conveyor belt.

4. Apparatus as in claim 2 in which said arresting means comprises a stop member and means for selectively moving said stop member across the path of movement of said envelope to intercept its leading edge to prevent further movement of said envelope by said moving means.

5. Apparatus as in claim 4 in which said stop member is pivotally mounted for movement between a first position out of the path of movement of said envelope and a second position in said path of movement.

6. Apparatus as in claim 2 comprising means for separating the sides of the envelope arrested by said arresting means.

7. Apparatus as in claim 6 in which said separating means comprises a pair of suction cups disposed on opposite sides of the path of movement of said envelope, means for selectively moving said suction cups between a first position in which the faces of said cups lie in a common plane and a second position in which said cups are separated from one other, and means for selectively coupling said suction cups to a vacuum source.

8. Apparatus as in claim 7 in which said separating means comprises a plurality of cups disposed at horizontally spaced locations along one side of the path of movement of said envelope and at least one cup on the other side of said path of movement in staggered relationship with said plurality of cups.

9. Apparatus as in claim 1 in which said mounting means comprises, for each of said blades:

upper and lower mounting assemblies, each of said upper and lower mounting assemblies comprising a pitch chain and a plurality of sprockets for supporting said pitch chain, said plurality of sprockets including a first sprocket, a second sprocket mounted in horizontal spaced relationship with said first sprocket, and a third sprocket mounted in vertical spaced relationship with said first sprocket; and means for mounting said breaker blade at respective spaced locations therealong on said upper and lower mounting assembly pitch chains.

10. Apparatus as in claim 1 further comprising a rotary member and means for conveying said opened envelope to said rotary member.

11. Apparatus as in claim 1 further comprising a rotary member having a plurality of radially extending envelope receiving slots and means for conveying said opened envelope to one of said slots.

12. Apparatus as in claim 1 further comprising means including a rotary member for receiving the opened envelope and means responsive to the driving means for rotating said rotary member.

13. Appparatus as in claim 1 further comprising a turntable mounted for rotation about a vertical axis and means for conveying said opened envelope to said turntable.

14. Apparatus as in claim 10 in which said conveying means comprises a conveyor belt.

15. Apparatus as in claim 1 in which said positioning means comprises:

a generally horizontal surface for supporting the edge of the envelope, said support surface having a discharge end formed with an upwardly extending retaining lip;

a retaining member disposed above said lip;

means for urging the envelope against the lip and the retaining member;

means for pulling the supported envelope edge across the lip to permit the envelope to move downwardly from said support surface along a discharge path; and means for receiving the envelope moving downwardly along said discharge path and conveying said envelope to a position adjacent said blades.

16. Apparatus as in claim 9 in which each of said upper and lower mounting assemblies comprises a fourth sprocket mounted in vertical spaced relationship with said second sprocket and in horizontal spaced relationship with said third sprocket.

17. Envelope opening and holding apparatus comprising:

means for opening envelopes fed sequentially thereto;

a member mounted for rotation on a vertical axis, said member having a plurality of radially extending slots for receiving envelopes, each of said slots opening upwardly and outwardly radially and having a bottom wall and generally vertical side walls for supporting an envelope on edge;

means for rotating said member in synchronism with the operation of said opening means; and means for delivering an opened envelope from said opening means to one of said receiving slots in a first predetermined rotary position of said member.

18. Apparatus as in claim 17 in which each of said envelope receiving slots is formed with a V-shaped cross-section.

19. Apparatus as in claim 17 in which each of said envelope receiving slots is formed with outwardly diverging side wall portions at the peripheral end of said slot to form a mouth at said end.

20. Apparatus as in claim 17 in which said member comprises a plurality of vanes extending radially from the center thereof, each of said vanes extending over the inner portion of an envelope receiving slot.

21. Apparatus as in claim 17, which further comprises means for removing the contents of an envelope receiving slot when said slot has rotated to a predetermined second orientation.

22. Apparatus as in claim 21 in which said contents removing means comprises a high friction disc mounted for rotation on a vertical axis at a fixed point above said member, and means for rotating said disc at a relatively high speed in the same direction as the member to radially eject the envelope receiving slot contents as said slot is rotated past said high friction disc.

23. Apparatus as in claim 22, which further comprises deflector means for deflecting downward the contents ejected from said envelope receiving slot.

24. Apparatus as in claim 17 in which said delivering means comprises a conveyor belt having an end disposed adjacent to said member.

25. Apparatus for successively delivering envelopes from a stack, comprising:

support means for receiving a stack of envelopes on edge, said support means including a support surface with an edge;

lower retainer means disposed slightly above the edge of said support surface;

a friction roller disposed above said lower retainer means, said friction roller abutting the leading envelope of said stack between the upper and lower edges thereof;

means for urging the stack of envelopes against said lower retainer means and said friction roller;

a suction device;

means for moving said suction device into engagement with the leading envelope of said stack at a point between said friction roller and said lower retainer means to grip said envelope and for sequentially moving said suction device away from the stack of envelopes to pull said leading envelope over said lower retainer means; and means for rotating the friction roller in such a direction as to move the leading envelope downwardly away from said roller to separate said envelope from said stack.

26. Apparatus as in claim 25 in which said lower retainer means comprises a lip extending upwardly from the edge of said support surface.

27. Apparatus as in claim 26 comprising pair of friction rollers mounted on said shaft on opposite sides of said lip, said rotating means rotating said friction rollers in such a direction as to move the leading envelope downwardly away from said rollers.

28. Apparatus as in claim 25, further comprising a pair of opposing feed rollers for receiving the separated envelope, said rollers being disposed below the edge of said support surface.

29. Apparatus as in claim 25 in which said support surface is inclined upwardly away from said edge, said urging means comprising a movable member abutting the rear surface of the stack of envelopes.

30. Apparatus as in claim 25 in which said friction roller abuts the leading envelope of the stack at a first height, said support means having a region above said support surface free of obstructions up to a second height appreciably greater than said first height.

* * * * *

UNITED STATES PATENT AND TRADEMARK OFFICE

CERTIFICATE OF CORRECTION

PATENT NO. : 4,050,222

DATED : September 27, 1977

INVENTOR(S) : Frederick N. Stephens, Glenford Rowlett and James D. Beard

It is certified that error appears in the above-identified patent and that said Letters Patent are hereby corrected as shown below:

Column 10, line 42, "9" should read -- a --.

Column 11, line 52, "appparatus" should read -- apparatus--.

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*